US005951356A

United States Patent [19]

Cyrus et al.

[11] Patent Number: 5,951,356

[45] Date of Patent: Sep. 14, 1999

[54] MODULAR LATTICE SUBSTRUCTURE FOR A TOY BUILDING SET HAVING COLUMNS AND FOUNDATIONS

[75] Inventors: Peter Cyrus; Sean Cryan; Steve Proctor; Rich Franko, all of Seattle; Chris Brady, Bothell; David Wicklander; Gary Franz, both of Seattle, all of Wash.

[73] Assignee: Parvia Corporation, Seattle, Wash.

[21] Appl. No.: 08/957,858

[22] Filed: Oct. 27, 1997

[51] Int. Cl.[6] ..... A63H 33/06; A63H 33/08; A63H 3/52

[52] U.S. Cl. ..... 446/118; 446/110; 446/121; 446/127; 446/128; 446/476

[58] Field of Search ..... 446/118, 117, 446/116, 115, 111, 110, 108, 107, 106, 105, 128, 127, 122, 121, 120, 476, 478; 434/72, 74

[56] References Cited

U.S. PATENT DOCUMENTS

| | | | |
|---|---|---|---|
| D. 304,484 | 11/1989 | Knudsen . | |
| D. 306,188 | 2/1990 | Tapdrup et al. . | |
| D. 306,190 | 2/1990 | Poulsen . | |
| D. 307,775 | 5/1990 | Pedersen . | |
| D. 366,914 | 2/1996 | Frederiksen . | |
| D. 367,896 | 3/1996 | Knudsen . | |
| D. 367,897 | 3/1996 | Schmidt et al. . | |
| 1,393,163 | 10/1921 | Rasely . | |
| 1,985,032 | 12/1934 | Hoult . | |
| 2,406,759 | 9/1946 | Glukes | 446/127 |
| 2,619,829 | 12/1952 | Tatum . | |
| 2,674,813 | 4/1954 | Hutchinson . | |
| 2,676,420 | 4/1954 | Berg | 434/72 |
| 2,871,619 | 2/1959 | Walters . | |
| 2,907,137 | 10/1959 | Ehrmann . | |
| 2,942,354 | 6/1960 | Grain . | |
| 3,005,282 | 10/1961 | Christiansen . | |
| 3,025,626 | 3/1962 | Schumacher . | |
| 3,034,254 | 5/1962 | Christiansen . | |
| 3,132,443 | 5/1964 | Kuhn | 446/127 X |
| 3,162,973 | 12/1964 | Christiansen . | |
| 3,168,793 | 2/1965 | Gibson . | |
| 3,233,358 | 2/1966 | Dehm | 446/128 X |
| 3,234,683 | 2/1966 | Christiansen . | |
| 3,236,004 | 2/1966 | Christiansen . | |
| 3,242,610 | 3/1966 | Christiansen . | |
| 3,284,946 | 11/1966 | Christiansen . | |
| 3,352,054 | 11/1967 | Glass et al. . | |
| 3,461,601 | 8/1969 | Kristiansen . | |
| 3,475,851 | 11/1969 | Christiansen . | |
| 3,597,858 | 8/1971 | Ogsbury . | |

(List continued on next page.)

FOREIGN PATENT DOCUMENTS

| | | | |
|---|---|---|---|
| 184497 | 1/1956 | Austria | 446/128 |
| 2056230 | 5/1972 | Germany . | |
| 2429491 | 1/1975 | Germany | 446/128 |
| 2711724 | 9/1978 | Germany . | |
| 3620379 | 12/1987 | Germany | 446/128 |
| 477823 | 3/1954 | Italy | 446/128 |
| 6615085 | 6/1967 | Netherlands . | |
| 8101581 | 10/1982 | Netherlands . | |
| 385086 | 11/1964 | Switzerland . | |
| 890608 | 3/1962 | United Kingdom | 446/128 |

*Primary Examiner*—D Neal Muir
*Attorney, Agent, or Firm*—Christensen O'Connor Johnson & Kindness PLLC

[57] ABSTRACT

The modular lattice substructure for a playing structure, such as a toy building set, includes a planar frame having a plurality of exterior corners and a column having a height greater than the height of the frame. The column includes a lower portion and one of the lower portion of the column and a corner of the frame have a receptive connector thereon for removable attachment to a protrusion connector on the other of the lower portion of the column and a corner of the frame. In this manner, a single frame can be attached to a plurality of columns, and a single column can be attached to a plurality of frames in order to form a modular lattice substructure for a playing structure.

23 Claims, 7 Drawing Sheets

U.S. PATENT DOCUMENTS 3,597,875 8/1971 Christiansen .
3,667,153 6/1972 Christiansen .
3,742,620 7/1973 Knoll .
3,981,506 9/1976 Daniel et al. .
4,028,844 6/1977 Dideriksen et al. .
4,035,947 7/1977 Burge .
4,176,493 12/1979 Dideriksen .
4,185,410 1/1980 Kristiansen .
4,202,132 5/1980 Fischer .
4,203,248 5/1980 Tapdrup .
4,205,482 6/1980 Christiansen et al. .
4,214,403 7/1980 Knudsen .
4,245,400 1/1981 Johnson .
4,403,733 9/1983 Bach et al. .
4,430,063 2/1984 Bach et al. .
4,430,826 2/1984 Ryaa .
4,461,116 7/1984 Bach .
4,556,393 12/1985 Bolli .
4,579,041 4/1986 Organ et al. .
4,589,702 5/1986 Bach et al. .
4,624,647 11/1986 Munnix .
4,685,884 8/1987 Rohan .
4,715,832 12/1987 Bach .
4,726,515 2/1988 Bolli et al. .
4,743,202 5/1988 Bach .
4,846,750 7/1989 Tapdrup .
4,854,742 8/1989 Bach .
4,861,306 8/1989 Bolli et al. .
4,874,176 10/1989 Auerbach .
4,883,440 11/1989 Bolli .
4,894,040 1/1990 Bach et al. .
4,895,544 1/1990 Fischer .
4,895,548 1/1990 Holland et al. .
4,897,066 1/1990 Tapdrup et al. .
4,932,916 6/1990 Blickle .
4,937,181 6/1990 Rogers .
4,978,301 12/1990 Dodge .
4,988,322 1/1991 Knudsen .
4,988,324 1/1991 Ryaa et al. .
4,992,069 2/1991 Bolli et al. .
4,998,903 3/1991 Bolli et al. .
5,011,411 4/1991 Loewy .
5,015,210 5/1991 Dideriksen .
5,042,972 8/1991 Bach et al. .
5,049,078 9/1991 Thomsen .
5,049,104 9/1991 Olsen .
5,071,384 12/1991 Poulsen .
5,087,001 2/1992 Bolli et al. .
5,094,643 3/1992 Bolli et al. .
5,112,263 5/1992 Penillard et al. .
5,251,900 10/1993 Gallant .
5,304,086 4/1994 Bolli et al. .
5,322,466 6/1994 Bolli et al. .
5,326,267 7/1994 Brokaw .
5,348,478 9/1994 Bradshaw .
5,349,734 9/1994 Poulsen et al. .
5,360,364 11/1994 Poulsen et al. .
5,373,791 12/1994 Bach et al. .
5,378,191 1/1995 Ryaa .
5,380,232 1/1995 Berggreen et al. .
5,387,148 2/1995 Dideriksen et al. .
5,417,603 5/1995 De Chazal .
5,427,530 6/1995 Taggart .
5,427,558 6/1995 Knudsen et al. .
5,493,816 2/1996 Willemsen ..... 446/128 X
5,494,471 2/1996 Ryaa et al. .
5,580,295 12/1996 Ruzskai et al. .
5,596,181 1/1997 Bach et al. .
5,643,038 7/1997 Olsen et al. .
5,645,463 7/1997 Olsen .

MODULAR LATTICE SUBSTRUCTURE FOR A TOY BUILDING SET HAVING COLUMNS AND FOUNDATIONS

FIELD OF THE INVENTION

The invention relates to substructures for toy building sets and, more particularly, to modular lattices supporting toy building sets.

BACKGROUND OF THE INVENTION

In U.S. Pat. No. 5,427,530, a portable water pollution model and method are disclosed that provide an improved device and method for simulating water pollution. This invention includes a portable simulated watershed model, including a simulated body of water and a simulated water pollution source; a simulated water pollutant, placeable on selected portions of the model; a simulated best management practice for pollution minimization, placeable on selected portions of the model; and a fluid dispenser capable of simulating rain over the watershed model. This invention further includes a method for simulating water pollution including providing a portable simulated watershed model, providing a simulated water pollutant, placing the simulated pollutant on selected portions of the model, providing a simulated best management practice, placing the simulated practice on selected portions of the model, and simulating rain over the model.

In U.S. Pat. No. 5,417,603, a playing structure includes a plurality of playing structure modules connectable together to form an array having a generally continuous, visually fluid, three-dimensional playing surface. Each playing structure module has a reversible top to allow the topography of the playing surface to be changed. The top of each playing structure module has a different three-dimensional topography on either side thereof. Each playing structure module may have a different or the same top. The playing surfaces have a colored landscape painted thereon to depict lakes, countrysides, roadways etc. and the like. The topography of the playing surfaces and the painted landscapes are designed so that the certain symmetries exist. In particular, when a plurality of playing structure modules are assembled to form an array and the tops of the playing structure modules are arranged to provide a playing surface having a continuous, visually fluid landscape, any one of or all of the tops can be reversed along a diagonal and the landscape of the resulting playing surface will still be continuous and visually fluid. This of course increases the number of different playing surfaces which can be created with the playing structure modules.

In U.S. Pat. No. 5,348,478, a modular terrain board is provided having a plurality of sections or terrain cell plugs which are held in place by a baseboard assembly having a corresponding plurality of cell receiving sections or cells formed therein. The terrain cell plugs can be easily removed to allow for quick and accurate reconfiguration of the terrain model. The terrain board has means for representing buildings, rivers, lakes, roads, and other topographical features.

In U.S. Pat. No. 5,326,267, model terrain accessories that are positioned for use on the surface of a miniature landscape are fabricated from a permanently flexible material, preferably polyvinyl chloride. These flexible accessories are realistically contoured models representing roads, streams, stream banks, earthworks, and walls, or segments thereof. These flexible accessories will conform to changes in surface elevation on any miniature landscape on which they are assembled. The flexible accessories fit together easily in an infinite variety of individual and group configurations, and can be easily removed from the landscape surface and reused when desired.

U.S. Pat. No. 5,251,900 discloses a puzzle formed of a plurality of puzzle pieces which, when assembled, create a self-standing, three-dimensional building structure. The puzzle pieces are of irregular, polygonal shape, but all puzzle pieces are flat, planar blocks. The blocks are releasably interlocked about a common plane with first, edgewise, complementary dovetail joints. For interlocking puzzle walls that are transverse to one another, second, straight U-shape, edgewise, complementary tenon and mortise joints are further provided edgewisely of those corner blocks for frictional interlocking. Thus, no separate pin, bent units or the like are required to anchor the corner portions of the three dimensional structure. The self-standing, enclosing structure is continuous, and shows a continuous image on its external face.

U.S. Pat. No. 5,011,411 discloses a method making a non-repetitive modular design. The design is created by assembling a plurality of substantially identical modules to cover a surface. Each module has the shape of a polygon, especially a regular polygon, such as a square. The design of each module is created in the following manner. First, one selects a set of points, disposed symmetrically around the midpoint of a side of the polygon, and duplicates the same pattern of points for the remaining sides. Then, one connects every pair of points with a line, such that the lines so drawn form a pattern which is not symmetrical around any imaginary straight line joining any pair of vertices of the polygon. The spaces between lines, or between one or more lines and one or more sides of the polygon, can be filled in with a color, or with any other design element. To make the final design, one provides a plurality of such modules, and arranges them, with random orientations, to cover a surface. The design is non-repetitive, and any orientation of the individual modules will produce a valid design. The appearance of the design is varied by changing the orientation of one or more of the modules. In general, the appearance of the overall design is quite different from that of each of the modules. The modules made according to the invention can be used as floor tiles, or they can be otherwise secured permanently to a solid substrate for decorative purposes.

In U.S. Pat. No. 4,992,069, the plug-in building blocks of a building set have protruding connecting pins and corresponding mating connecting sockets. In order that bendproof trusses can also be built, the building set has single-row connecting bars with two terminal pins, whose spacing from one another amounts to $\sqrt{2}$ times an integral multiple of the modulus, and girder elements, which at two bordering sides faces each have a single row of pins with modular spacing and parallel to these side faces each have a projection set back by the thickness of the connecting bar. In this way, stable, aesthetically appealing trussings can be built with the building set.

In U.S. Pat. No. 4,988,322, a toy building set for building tree-like models comprises a trunk element and a branch element. The trunk element comprises a trunk portion and projecting branches having coupling means spaced from the trunk portion. The branch element comprises a plurality of connecting bars, at whose ends coupling bushings are provided. These bushings are formed with primary and secondary coupling means respectively, so that the branch elements may be interconnected and connected with the trunk elements. Preferably, said bars have additional branching portions whose ends are provided with bushings similar to the coupling bushings.

U.S. Pat. No. 4,978,301 discloses a construction set suitable and safe for children of various ages comprising construction pieces and connector strips. The construction pieces have a semirigid planar construction with opposing major sides which have hook fastener material disposed on one side and loop pile fastener material disposed on the other. The fastener materials are of the type which adhere when pressed together. An outer border or margin area of the construction pieces is kept free of the fastener materials, to provide a tab or hem for separating attached pieces. The construction pieces have various shapes and sizes with which many designs and structures may be constructed. The connector strips have a similar construction to the construction pieces and are used to join adjacent construction pieces. The sides may include complementary colors and patterns.

U.S. Pat. No. 4,937,181 discloses an educational visual display system for teaching geography in which objects having some geographical or topographical significance, e.g., states of the Union, may be detachably affixed and arranged to demonstrate relationship between the objects. The system includes a primary background surface of iron velvet fabric material to which hook type fasteners may be detachably adhered, a plurality of primary objects having geographical significance and comprising a soft foam core with a layer of iron velvet fabric on one side and a plurality of hook type fasteners on the other side, the primary objects being arrangeable to represent in combination a larger geographical unit, and a plurality of secondary objects each having geographical or topographical significance and having hook type fasteners on one side thereof for being detachably affixable to the layer of iron velvet fabric of the primary objects. The iron velvet fabric and the hook type fasteners function as an attachment pair similar to hook and loop fasteners sold under the tradename VELCRO®.

U.S. Pat. No. 4,874,176 discloses a three-dimensional puzzle including puzzle pieces having discrete surfaces, at least one surface of which has a three-dimensional sculpted form whereby the sculpted surfaces in the aggregate upon assembly of the puzzle form a continuous three-dimensional pictorial representation. Abutting sides of the puzzle pieces may be interlocking or three-dimensional for conformal abutting relation with the sides of opposed puzzle pieces. Filler pieces are also provided underlying the puzzle pieces for elevating the sculpted surfaces of the puzzle pieces. The puzzle pieces and filler pieces may be disposed on a base which may have an edge containment whereby non-interlocking puzzle and filler pieces may be used. The puzzle and filler pieces may be vertically interlocked against lateral movement and with respect to the base by projections received in corresponding recesses.

In U.S. Pat. No. 4,846,750, a base for a building set is provided with coupling studs for mounting building blocks having corresponding coupling elements. The base is further provided with cavities contoured to receive at least some of the building blocks. The cavities preferably extend from the side opposite the side provided with the coupling studs.

U.S. Pat. No. 4,743,202 discloses a toy building block having on one face thereof at least one row of mechanical coupling pins and opposite thereto mechanical counter-coupling tubes for coupling said toy building block to a similar toy building block either with the row of said coupling pins parallel to a corresponding row of coupling pins of said similar block or perpendicular to said corresponding row. The toy building block includes first and second current paths connected to first and second contact areas respectively designed to establish electrical connection with first and second contact areas in a similar block. The first and second contact areas are disposed in first and second angular sectors about adjacent coupling pins. The angular sectors are offset from each other and do not overlap regardless of whether the building block row of coupling pins is parallel or perpendicular to the row of coupling pins of the similar block.

U.S. Pat. No. 4,715,832 discloses a building element of the type which contains current-carrying components placed in the electrically insulated building block. There are provided at least two current-carrying components with respective contact areas which are mutually- co-axially positioned. The building blocks can be intercoupled mechanically while establishing electrical connection between the respective current rails in the cooperating building elements, without any risk of short circuiting between the two current-carrying components, no matter how the building blocks are intercoupled mechanically.

U.S. Pat. No. 4,685,884 discloses a multitude of parts of three-dimensional shape have full edges and also edge segments adapted for abutment with like edges and edge segments of other parts. The parts additionally include non-abutting irregular or curved edges which may represent terrain contour lines or the bank of a body of water. Inclined areas on the parts are adjacent the irregular or curved edges and represent sloped terrain which is continuous with like inclined areas on other abutting parts. The inclined area of a part may be dispensed with to provide a vertical surface to simulate an escarpment.

U.S. Pat. No. 4,556,393 discloses a building block having side walls and a perpendicular front with two rows of coupling pins on one side of the front face and counter-coupling tubes on the other side for mechanically coupling two building blocks by means of a clamping action. In each row, each second coupling pin has an electrically conducting surface, while the coupling pins lying between these are electrically insulating. One row of conducting pins is displaced in the direction of the rows by one coupling pin from the adjacent row. On the other side of the front wall a contact bar is arranged which is connected electrically with the conducting coupling pins of an associated row. The bar has a contact area for producing electrical contact with a row of conducting coupling pins of an adjacent, coupled building block.

U.S. Pat. No. 4,461,116 discloses a connecting member comprising an elastically deformable, tubular plug slitted at the ends for interconnecting pairs of building components, which have coupling holes to receive the ends of the connecting member. Apertures are in the plug wall between the slits. The plug wall is formed with lengthwise extending clamping wedges between the apertures. The clamping wedges have inclined faces which slope towards the ends of the connecting member and cause the connecting member to be compressed at the center and be expanded at the ends when it is pressed into a pair of co-axial holes in adjacent building components. The connecting member may in particular be formed with an annular flange and end beads which fit in corresponding annular grooves in a pair of adjacent components.

U.S. Pat. No. 4,245,400 discloses a three dimensional toy having a base member showing a housing development with structural profile members mounted thereon which are secured by profile locking elements for constructing elevations of roadways, lots and surrounding terrain. The profile members and locking elements also serve as retaining walls for soil which, when shaped to conform to the contours of the profile members and locking elements and provided with living plants defines the topography of a living housing development.

U.S. Pat. No. 4,185,410 discloses a suspension device for slideable and pivotal suspension of a base plate for toy building sets or base boards for visual planning panels. One face of the base plate or board is provided with rows of coupling studs including a plurality of studs uniformly spaced apart in both longitudinal and transverse directions, and the suspension device includes a gripping member having inwardly projecting guides adapted to slide along the base plate between a pair of rows of projections and to support the base plate when suspended on a wall. The device is further provided with a hinge member pivotally mounted on top of the gripping member, so as to provide for pivotal movements of the base plate relatively to a wall on which the base plate is mounted by means of the slideable suspension device.

U.S. Pat. No. 4,176,493 discloses a rotatable element comprising a base plate and a disc pivotally mounted in a circular aperture in the base plate. A socket for a pivot on the disc is located at the bottom of the plate and is supported thereon by ribs integral with the socket and with four side walls at the bottom of the base plate. Four identical apertures in the bottom of the base plate are formed by the socket, the ribs and the side walls. Four engagement studs are provided on the top face of the disc and extend beyond the periphery thereof. The underface of these studs provides for slideable contact with the top face of the base plate during the rotation of the disc.

In U.S. Pat. No. 3,981,506, a plurality of parallelepiped blocks having varying heights, planar sides and a curved upper surface are connected together by special pin and hole interlocks randomly spaced in predetermined locations to form a three dimensional puzzle with at least a curved upper surface. Two or more puzzles can be made by initially assembling the blocks into a polyhedron with six rectangular faces and sawing along a predetermined path to separate the polyhedron into individual puzzles.

In U.S. Pat. No. 3,742,620, there is provided an apparatus for demonstrating the inter-relationship of a landscape, and the contour lines representing said landscape in two- and three-dimensional representation. A transparent plate is supported over and free from the model and contour lines connecting points of the same height on the model are drawn upon the said plate using a substantially ablative transfer material, said contour lines are transferred onto transfer receiving material slabs and layers of the material corresponding to the contour lines are produced by cutting along the contour lines. The contour slabs are then stacked upon each other to give a three-dimensional representation of the model. In a further modification, the contour slabs are colored in such a manner that at least adjacent slabs are of a different color. Upon compression of the contour model by a transparent plate, a two-dimensional contour representation is again visible.

U.S. Pat. No. 3,667,153 discloses the coupling of two plate-shaped elements by means of an interlocking arrangement formed along the edges of the elements. The locking members of one element are in resilient engagement with identical locking members on the other element, the thickness of the individual locking members being half the thickness of the element, and the members being staggered alternately to one side and the other of a plane through the center of the edge parallel to the side faces of the element.

U.S. Pat. No. 3,597,875 discloses toy building blocks of similar shape but constructed to different modules. The inner protrusions of the smaller blocks coact with the outer projections of the larger blocks.

In U.S. Pat. No. 3,597,858, there is provided a plurality of building elements dimensionally related to conform to a selected scale having interlocking socket and beaded joint portions which may be assembled into a wide variety of composite structures including scale model buildings. The socket joint portion is slotted for insertion of the beaded joint portion and firmly grips the beaded joint portion to hold the elements in particular angular relation while at the same time permitting substantial forced rotational and sliding movement between elements. One of the elements is a flat panel which may be of a variety of geometric shapes and another of the elements is a connector of preselected lengths having plural joint portions arranged in angular spaced relation to one another about a common midpoint.

SUMMARY OF THE INVENTION

The modular lattice substructure for a playing structure, such as a toy building set, includes a planar frame having a plurality of exterior corners and a column having a height greater than the height of the frame. The column includes a lower portion and one of the lower portion of the column and a corner of the frame have a receptive connector thereon for removable attachment to a protrusion connector on the other of the lower portion of the column and a corner of the frame. In this manner, a single frame can be attached to a plurality of columns, and a single column can be attached to a plurality of frames in order to form a modular lattice substructure for a playing structure.

Most preferably, each frame is parallelogram-shaped, with four exterior corners for attachment to four columns, and each column has four sides with connectors thereon for attachment to four frames. The connector on the exterior corners of the frame are preferably receptive connectors and the connectors on the lower portions of each side of the columns are preferably protrusion connectors. The protrusion connectors on the columns can either be perpendicularly disposed to the longitudinal axis of the column, or parallel thereto. Each exterior corner of the frame may have either one or two connectors thereon, and each side of the lower portion of each column can have either one or two connectors thereon that are mateable with the connector or connectors of an exterior corner of the frame. The column preferably has an upper portion, or top, with connectors thereon for removable attachment of the column to a playing structure component above the frame. The connectors on the upper portion, or top, of the column can be clover leaf-shaped or shaped to have a triangular cross section. Additionally, the column preferably has connectors on its underside for removable attachment of the column to a playing structure component below the frame.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
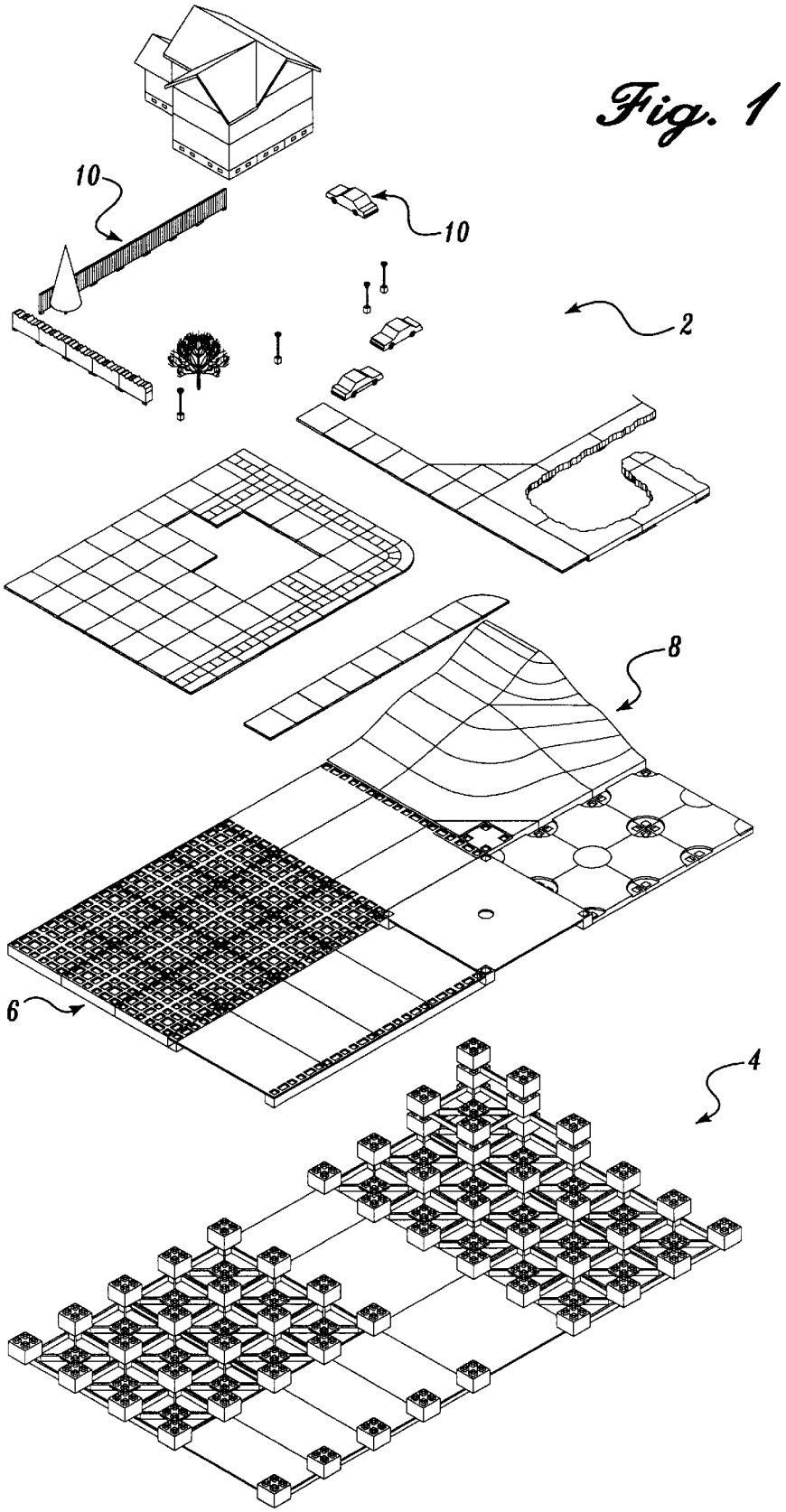
FIG. 1 is an exploded isometric view of an embodiment of the modular toy building set embodying the present invention.

Referring to FIG. 1, modular toy building set 2 generally includes lattice 4, base 6, terrain 8, and playing components 10. More specifically, lattice 4 supports, and is removably attachable to, base 6. In turn, base 6 supports, and is removably attachable to playing components 10. Lattice 4 also supports, and is removably attachable to terrain 8. The modular aspects of lattice 4, base 6, terrain 8, and playing components 10 allows a multitude of different configurations to be created with modular toy building set 2 while employing the same elements of lattice 4, base 6, terrain 8, and playing components 10. Lattice 4, base 6, terrain 8, and playing components 10 are preferably comprised of a synthetic polymer such as acrylonitrilebutadiene styrene (ABS). This synthetic polymer can be extruded or injection molded to form lattice 4, base 6, terrain 8, and playing components 10.

Figure 2:
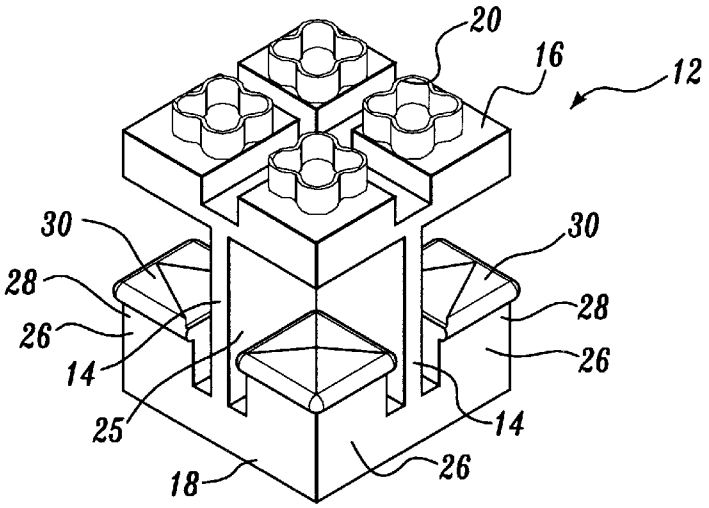
FIG. 2 is an isometric view of the column of the lattice of a first embodiment of the modular toy building set embodying the present invention.
Figure 3:
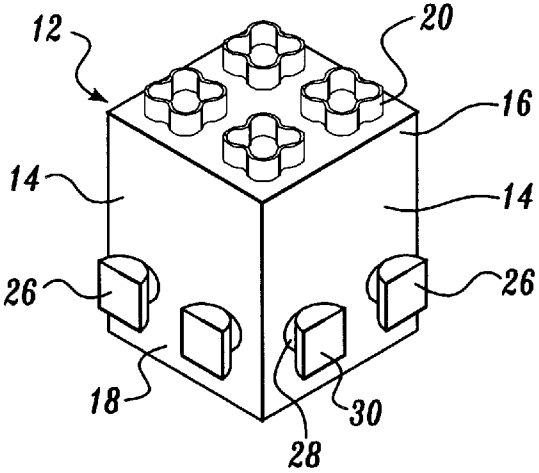
FIG. 3 is an isometric view of the column of the lattice of a second embodiment of the modular toy building set embodying the present invention.
Figure 4:
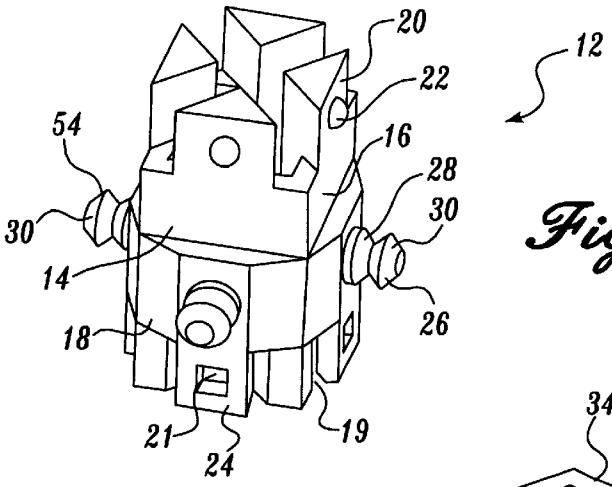
FIG. 4 is an isometric view of the column of the lattice of a third embodiment of the modular toy building set embodying the present invention.

Referring to FIGS. 2–4, column 12 of the three embodiments of lattice 4 are shown in detail. Column 12 is substantially cubic in shape, but preferably has a height slightly greater than its width. Column 12 has four sides 14, a top (or upper portion) 16, and a bottom (or lower portion) 18. Male fittings 20 are preferably located on top 16 of column 12. Additionally, while male fittings 20 are shown on the upper end of top 16 of column 12, male fittings 20 could, instead, be female fittings provided that the component to which top 16 of column 12 is to be attached has the appropriate mating fitting thereon. Similarly, as discussed throughout the rest of this description, wherever a female fitting (or conversely male fitting) is mentioned, a male fitting (or conversely a female fitting) can be employed in its stead as long as complementary fittings are present on components to be removably attached. Bottom (or lower portion) 18 of column 12 preferably has a plurality of female fittings on its underside in the same configuration and orientation as the male fittings 20 on top 16 of column 12. The male fittings 20 on top 16 and the female fittings on bottom 18 of column 12 allow for secure, removable vertical stacking of a plurality of columns 12, in order to vary the height of lattice 4. While male fittings 20 on top 16 of column 12 are substantially clover leaf in shape, in FIGS. 2 and 3, and have triangular cross-sections with snap fit nubs 22 in FIG. 4, the male fittings discussed herein, as well as the female fittings, can be of any shape that provides removable attachment of two components with a secure connection when attached. For example, the female fittings 19 on the under side of bottom (or lower portion) 18 of the embodiment of FIG. 4 is comprised of a plurality of spaced apart fingers 24 that bound triangular-shaped openings in which male fittings 20 having triangular-shaped cross-sections on other columns 12 can fit. Additionally, each finger 24 has an opening 21 in its side shaped to receive snap fit nub 22 of male fittings 20.

For all three embodiments, each of sides 14 of column 12 adjacent lower portion 18 preferably has a protrusion connector 26 thereon. Each protrusion connector 26 has a shaft 28, and a head 30 on the end of shaft 28. Protrusion connectors 26 are sized and shaped to mate with complementary receptive connectors on other components in a manner further described below. Note that the columns 12 of the embodiments of FIGS. 3 and 4 are substantially solid cubes with perpendicular protrusion connectors 26, while column 12 of the embodiment of FIG. 2 has spaces 25 between upper portion 16 and lower portion 18 that are bounded by protrusion connectors 26, which are parallel to the longitudinal axis of column 12.

Figure 5:
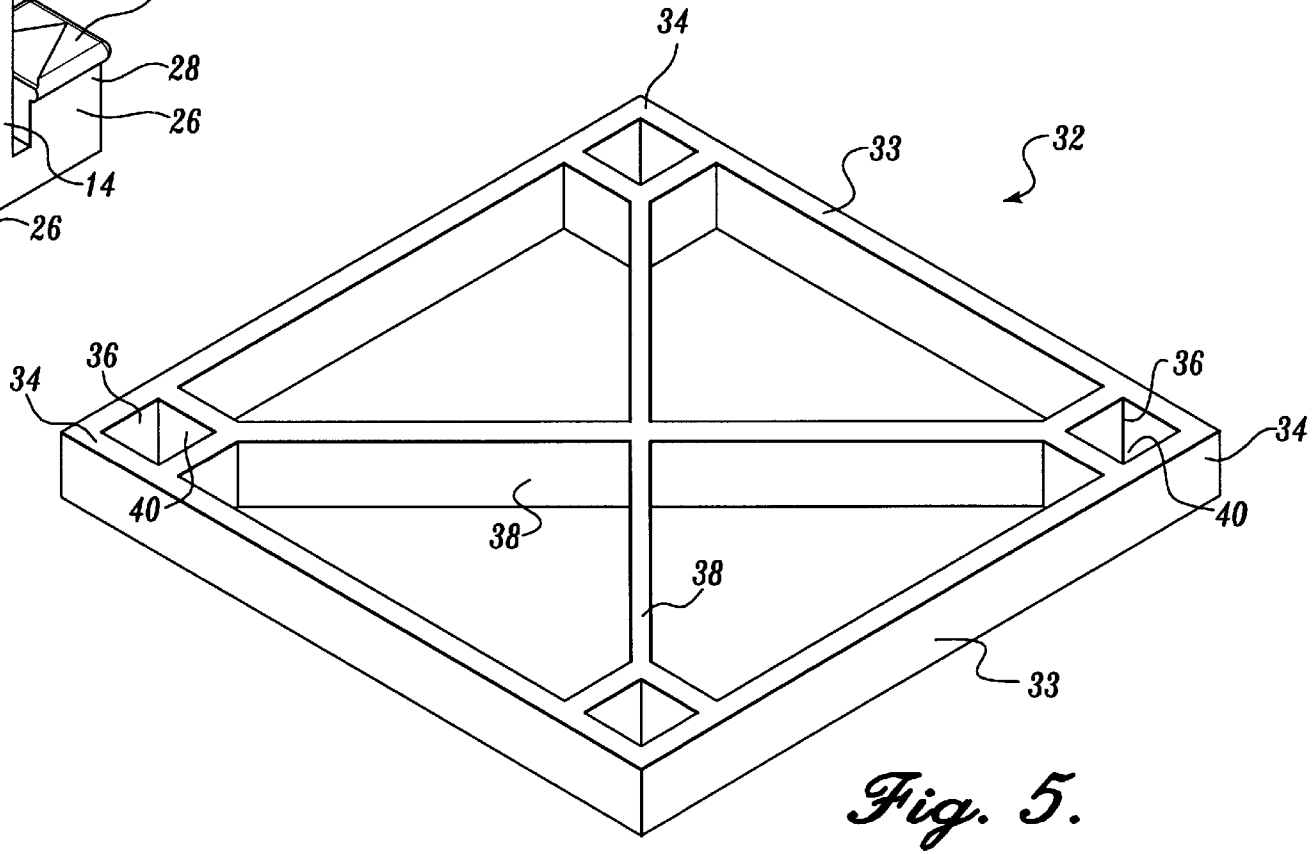
FIG. 5 is an isometric view of the frame of the lattice of a first embodiment of the modular toy building set embodying the present invention.
Figure 6:
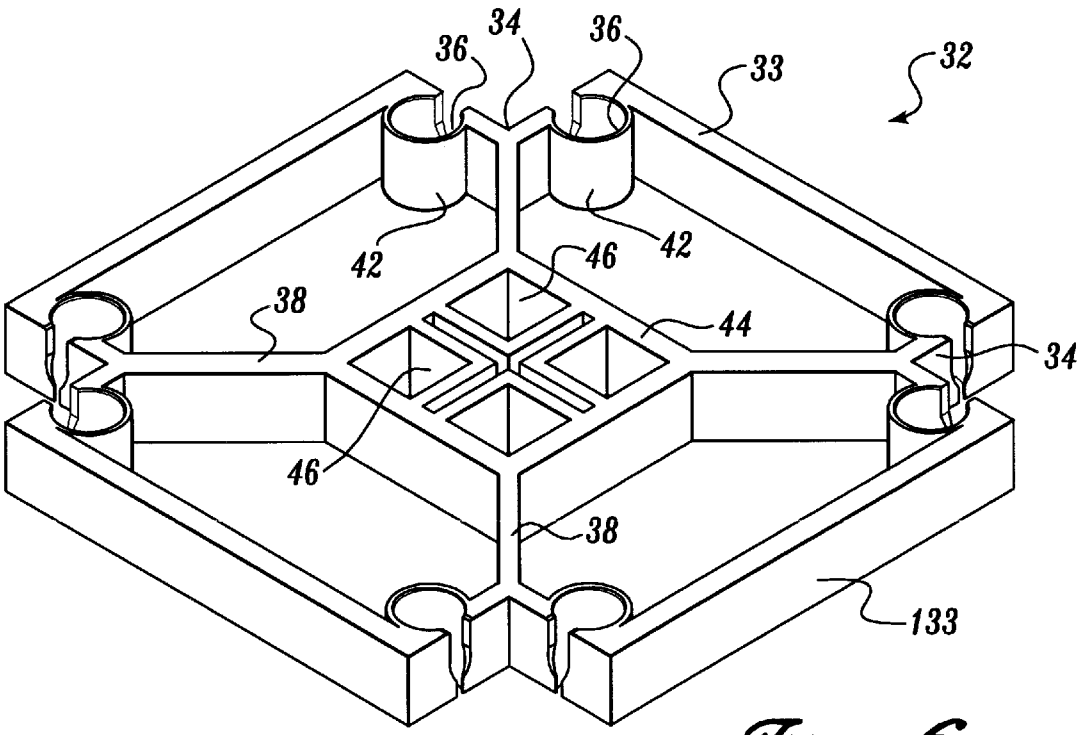
FIG. 6 is an isometric view of the frame of the lattice of a second embodiment of the modular toy building set embodying the present invention.
Figure 7:
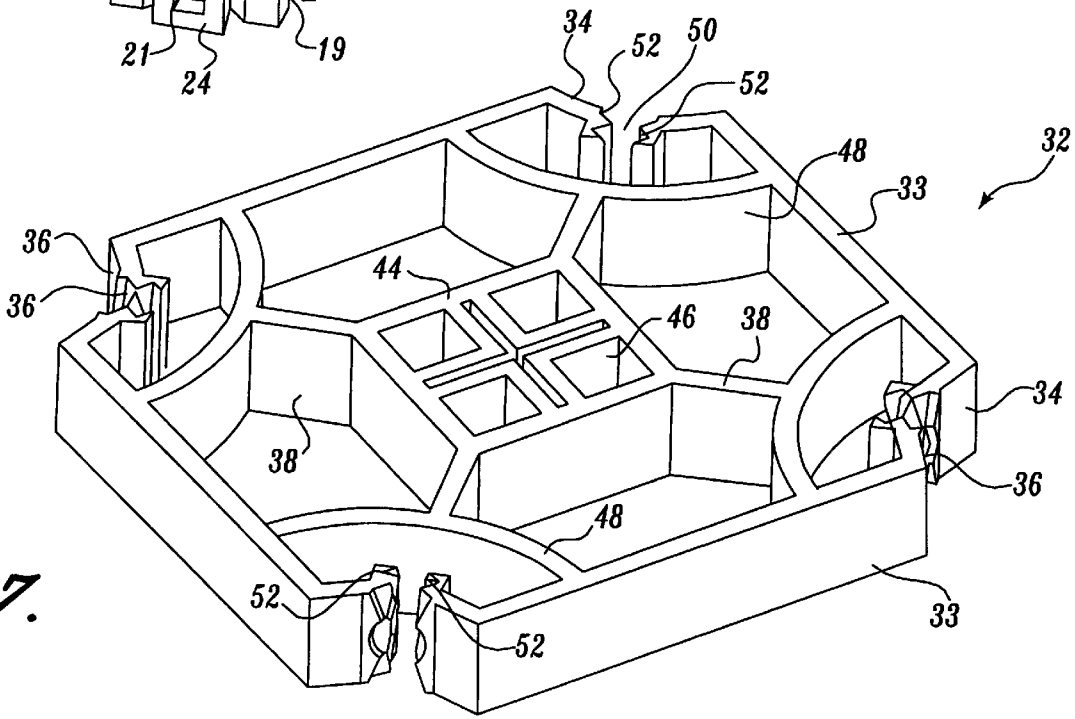
FIG. 7 is an isometric view of the frame of the lattice of a third embodiment of the modular toy building set embodying the present invention.
Figure 8:
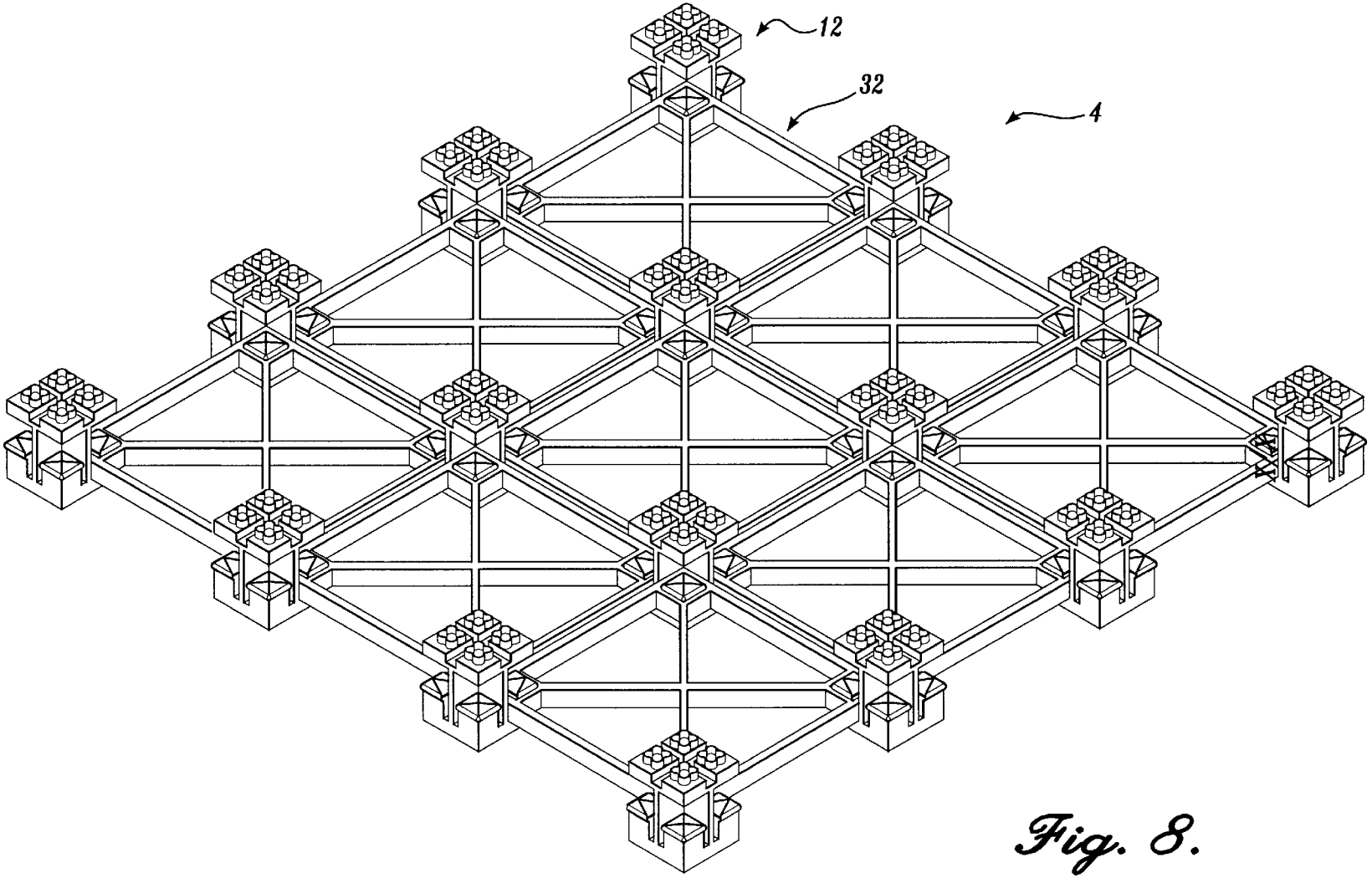
FIG. 8 is an isometric view of the column and frame of the lattice of the first embodiment of the modular toy building set embodying the present invention.

Next, referring to FIGS. 5, 6 and 7, three embodiments of frames 32 are shown. In all three embodiments, frame 32 is preferably parallelogram in shape with four outer walls 33 and is most preferably square. Frame 32 has a height less than the height of column 12. The four corners 34 of frame 32 each have a receptive connector 36 therein. Intersecting stabilizing beams 38 interconnect opposite corners 34. Referring to the embodiment of frame 32 of FIG. 5, a single square-shaped opening 40 in each corner 34 forms receptive connector 36. Opening 40 is perpendicular to the plane of frame 32. The diameter of opening 40 forming receptive connector 36 is slightly less than that of head 30 of protrusion connector 26 of column 12 of FIG. 2, and is slightly greater than that of shaft 28 of protrusion connector 26 for removable snap fitting of column 12 of FIG. 2 with frame 32 of FIG. 5 as shown in FIG. 8.

Figure 9:
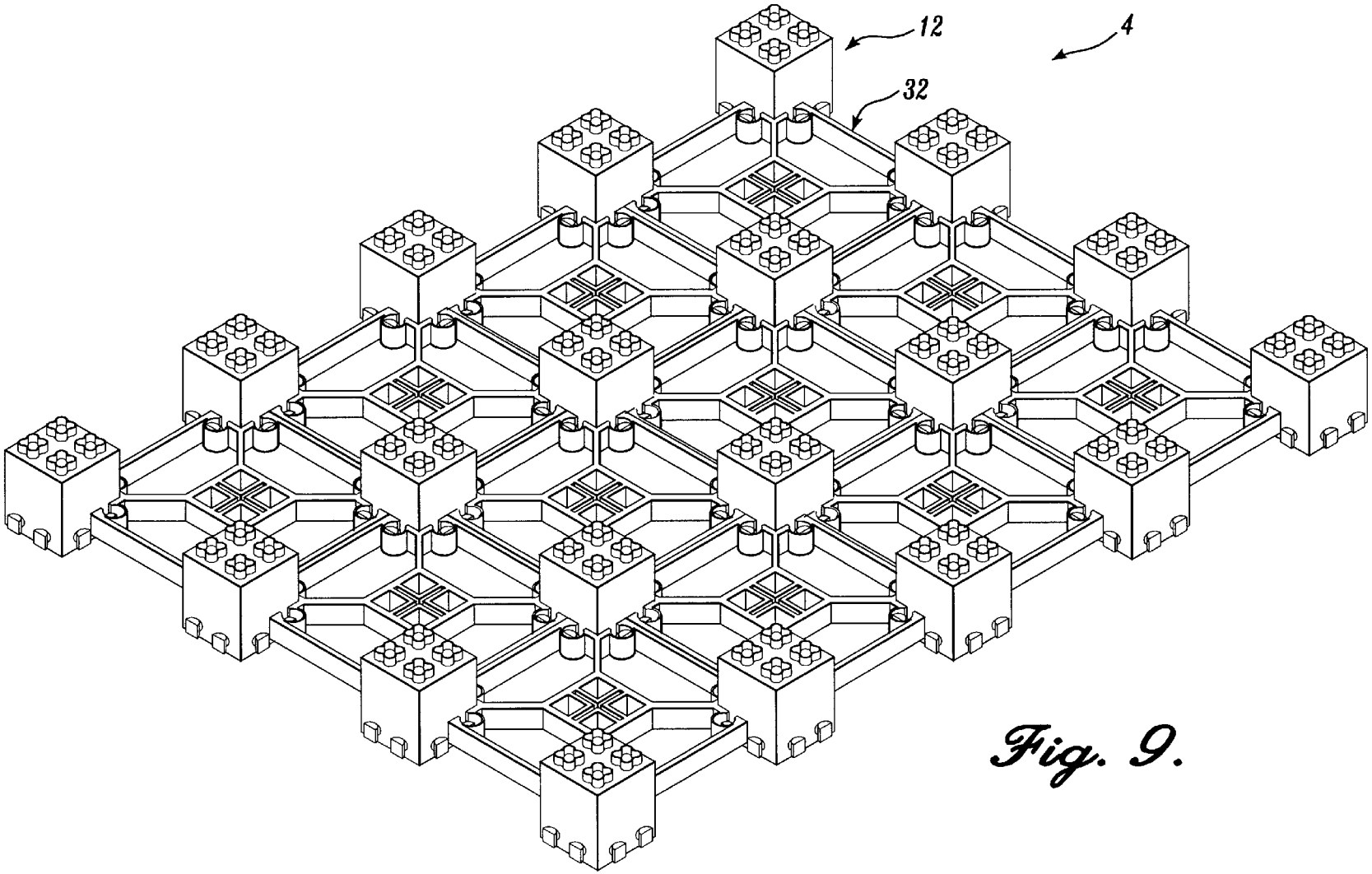
FIG. 9 is an isometric view of the column and frame of the lattice of the second embodiment of the modular toy building set embodying the present invention.

Regarding the embodiment of frame 32 of FIG. 6, the receptive connector 36 of each corner 34 includes a pair of C-shaped partial tubes 42 attached to the outer end of each stabilizing beam 38 at their inner ends and to the outer walls 33 of frame 32 at their outer ends. The interior diameter of each C-shaped partial tube 42 is slightly less than the diameter of head 30 of protrusion connector 26 of column 12 of FIG. 3 for removable interference fitting of column 12 of FIG. 3 with frame 32 of FIG. 6, as shown in FIG. 9. Head 30 of one of protrusion connector 26 of column 12 is slid into one of the C-shaped partial tubes 42 of frame 32 as column 12 is moved along its longitudinal axis with respect to frame 32. Two protrusion connectors 26 of column 12 mate with the two C-shaped partial tubes 42 of one of the corners 34 of frame 32. The interior ends of stabilizing beams 38 are connected to a parallelogram-shaped central seat 44 having a plurality of receptive connectors 46 for interconnection of frame 32 to additional structural elements.

Figure 10:
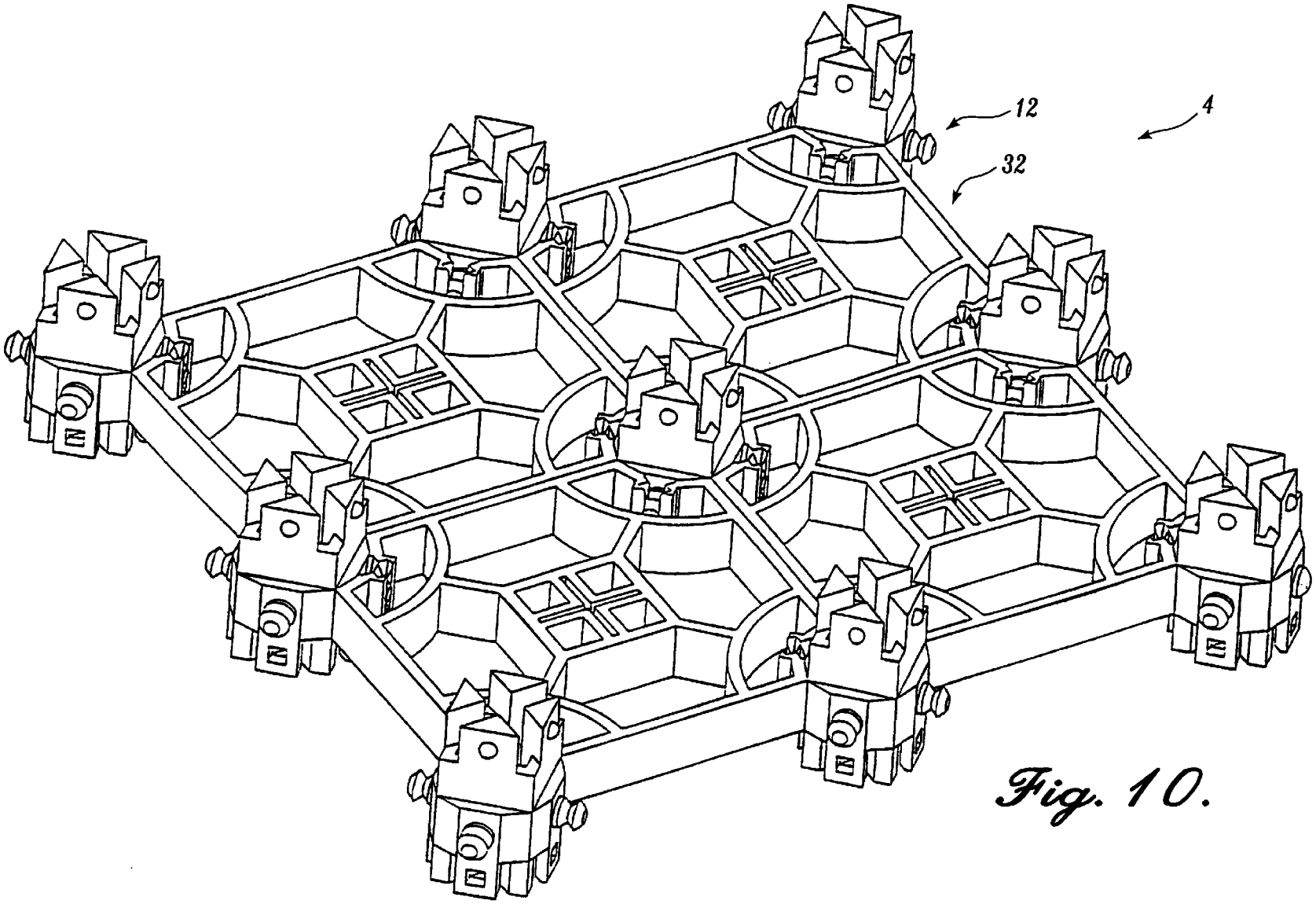
FIG. 10 is an isometric view of the column and frame of the lattice of the third embodiment of the modular toy building set embodying the present invention.

The embodiment of frame 32 of FIG. 7 also has a parallelogram-shaped central seat 44 having a plurality of receptive connectors 46 for interconnection of frame 32 to additional structural elements. Central seat 44 is connected to the interior ends of stabilizing beams 38. The exterior ends of stabilizing beams 38 each have C-shaped brace 48 thereon that is connected to adjacent ones of outer walls 33. Each corner 34 has a pair of spaced apart edges that form vertical slot 50 that defines receptive connector 36. Each edge of corner 34 that defines slot 50 has a vertical groove 52 therein that is orthogonal to slot 50. These two vertical grooves 52 receive the peripheral edge 54 of head 30 (head 30 being substantially circular in cross-section) of protrusion connector 26 of column 12 of FIG. 4 as head 30 of protrusion connector 26 is slid into slot 50, as shown in FIG. 10.

The above-described modular columns 12 and frame 32, having varying heights and lengths, and facilitating both horizontal and vertical interconnection, allow for a multitude of lattice configurations having individual components orthogonally disposed with respect to each other.

While the preferred embodiment of the invention has been illustrated and described, it will be appreciated that various changes can be made therein without departing from the spirit and scope of the invention.

The embodiments of the invention in which an exclusive property or privilege is claimed are as follows:

1. A modular lattice substructure for a playing structure comprising:

a plurality of planar frames, each frame being shaped as a parallelogram and each having a height and a corner connector at each corner of each frame, wherein at least one of said frames being a parallelogram of at least one more square in dimension than the other frames in the plurality; and a column having a height greater than the height of said frame, said column having an upper portion and a lower portion having a column connector, wherein one of said column connectors and said corner connectors of said frame being a receptive connector and the other of said column connectors or said corner connectors being a protrusion connector for removable attachment to one of said receptive connector.

2. The lattice of claim 1 wherein said corner connectors of each frame are receptive connectors and said column connectors are a protrusion connector.

3. The lattice of claim 1 wherein said upper portion of said column has a connector thereon for removable attachment of said column to a playing structure component above said frame.

4. The lattice of claim 3 wherein said connector on said upper portion of said column is clover leaf shaped.

5. The lattice of claim 3 wherein said connector on said upper portion of said column has a triangular cross section.

6. The lattice of claim 1 wherein said lower portion of said column has four sides each having one of said column connectors thereon.

7. The lattice of claim 1 wherein said exterior corners of said frames each having two of said corner connectors thereon and said lower portion of said column has four sides each having two of said column connectors thereon.

8. The lattice of claim 1 wherein said lower portion of said column has an end with connectors thereon for removable attachment of said column to a playing structure component below said frame.

9. A modular lattice substructure for a playing structure comprising:

a plurality of planar parallelogram-shaped, four-sided frames each having a height and a corner connector at each corner of each frame, at least one of the frames being a parallelogram of at least one more square in dimension than the other frames in the plurality; and a column having a height greater than the height of said frame, said column having an upper portion and a lower portion having a column connector, wherein one of said column connectors and said corner connectors of said frame being a receptive connector and the other of said column connector or said corner connector being a protrusion connector removably attached to one of said receptive connector.

10. The lattice of claim 9 wherein said corner connectors of said frames are receptive connectors and said column connectors are protrusion connectors.

11. The lattice of claim 9 wherein said upper portion of said column has a connector thereon for removable attachment of said column to a playing structure component above said frame.

12. The lattice of claim 11 wherein said connector on said upper portion of said column is clover leaf-shaped.

13. The lattice of claim 11 wherein said connector on said upper portion of said column has a triangular cross section.

14. The lattice of claim 9 wherein said lower portion of said column has four sides each having one of said column connectors thereon.

15. The lattice of claim 9 wherein the corners of said frames have two of said corner connectors thereon and said lower portion of said column has four sides each having two of said column connectors thereon.

16. The lattice of claim 9 wherein said lower portion of said column has an end with connectors thereon for removable attachment of said column to a playing structure component below said frame.

17. A modular lattice substructure for a playing structure comprising:

a plurality of planar parallelogram-shaped frames, each frame having a height and a corner connector at each corner of each frame, wherein at least one of said frames being a parallelogram of at least one more square in dimension than the other frames in the plurality; and a column having a height greater than the height of each frame, said column having an upper portion and a lower portion having a column connector, wherein one of of said column connector and said corner connector being a receptive connector and the other of said column connector or said corner connector being a protrusion connector removably attached to one of said receptive connector, said upper portion of said column having a connector thereon for removable attachment of said column to a playing structure component above said frame.

18. The lattice of claim 17 wherein each corner connector of each frame is a receptive connector and said column connectors are protrusion connectors.

19. The lattice of claim 17 wherein said connector on said upper portion of said column is clover leaf-shaped.

20. The lattice of claim 17 wherein said connector on said upper portion of said column has a triangular cross section.

21. The lattice of claim 17 wherein said lower portion of said column has four sides each having one of said column connectors thereon.

22. The lattice of claim 17 wherein each corner of said frames has two of said corner connectors thereon and said lower portion of said column has four sides each having two of said column connectors thereon.

23. The lattice of claim 17 wherein said lower portion of said column has an end with connectors thereon for removable attachment of said column to a playing structure component below said frame.

* * * * *

UNITED STATES PATENT AND TRADEMARK OFFICE

CERTIFICATE OF CORRECTION

PATENT NO. : 5,951,356

DATED : September 14, 1999

INVENTOR(S) : P. Cyrus et al.

It is certified that error appears in the above-identified patent and that said Letters Patent is hereby corrected as shown below:

On the title page, Item

| | | |
|---|---|---|
| [56] Pg. 1, col. 1 | Refs. Cited (U.S. Pats., Item 8) | After line beginning with "D. 367,897 3/1996 Schmidt et al." insert --D. 382,920 8/26/1997 Munir-- |

Signed and Sealed this

Second Day of January, 2001

*Attest:*

*Attesting Officer*

Q. TODD DICKINSON

*Commissioner of Patents and Trademarks*